United States Patent [19]

Jewett

[11] 3,951,095

[45] Apr. 20, 1976

[54] CROSSBAR WITH OAR GUIDES FOR BOATS HAVING FRONTWARD-ROWING BOAT-SPANNING OARS

[76] Inventor: Harold A. Jewett, 5451-42nd St., NW., Washington, D.C. 20015

[22] Filed: Apr. 17, 1975

[21] Appl. No.: 568,931

Related U.S. Application Data

[62] Division of Ser. No. 451,563, March 15, 1974, Pat. No. 3,879,779, which is a division of Ser. No. 383,379, July 27, 1973, Pat. No. 3,857,356.

[52] U.S. Cl. ..... 115/24.1

[51] Int. Cl.[2] ..... B63H 16/00

[58] Field of Search ..... 115/21, 24.1–24.6; 416/71, 74

[56] References Cited

UNITED STATES PATENTS

| | | | |
|---|---|---|---|
| 277,662 | 5/1883 | Beach | 115/24.5 |
| 2,518,648 | 8/1950 | Travis | 115/24.6 |

FOREIGN PATENTS OR APPLICATIONS

| | | | |
|---|---|---|---|
| 72,278 | 6/1947 | Norway | 115/24.1 |

*Primary Examiner*—Duane A. Reger
*Assistant Examiner*—Jesus D. Sotelo

[57] ABSTRACT

Novel frontward-rowing boat-spanning crisscrossed angular oars having many unique advantages over usual oars are mounted on an optionally portable crossbar disposed athwart the gunnels of a canoe, dinghy, skiff, or other rowable craft, the crossbar carrying carom-type shields to insure against intercontact between oars and boat structure or accessories in case of extremely abnormal or excessive submergence.

5 Claims, 37 Drawing Figures

FIG.4.
FIG.1.
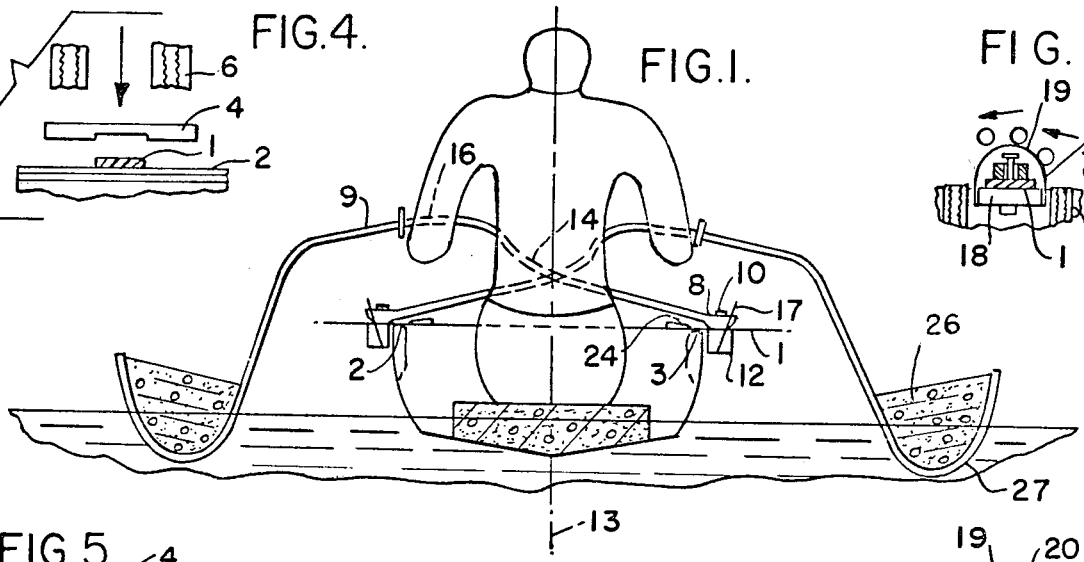
FIG. 7.
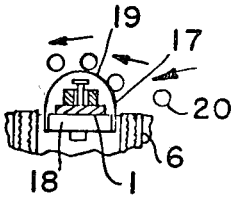
FIG.5.
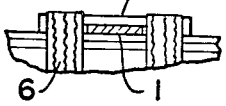
FIG.8.
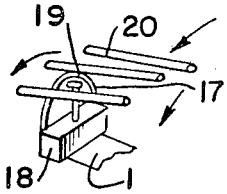
FIG.2.
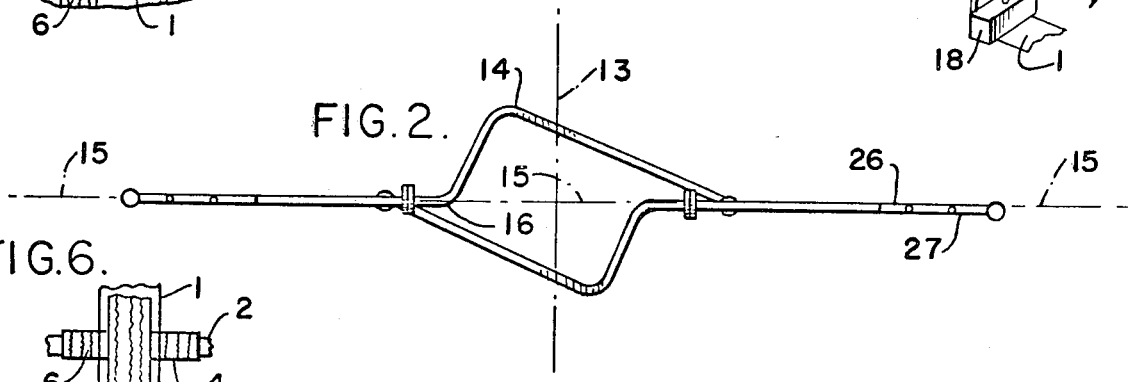
FIG.6.
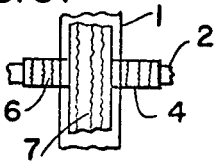
FIG. 3.
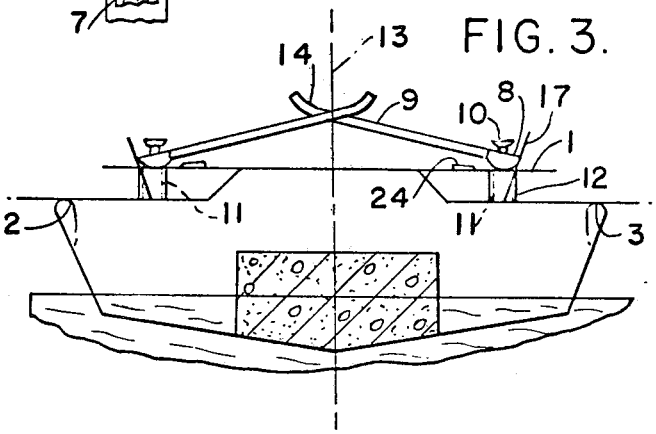
FIG. 9.
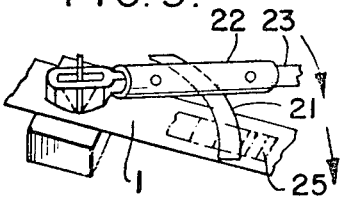

FIG. 17.
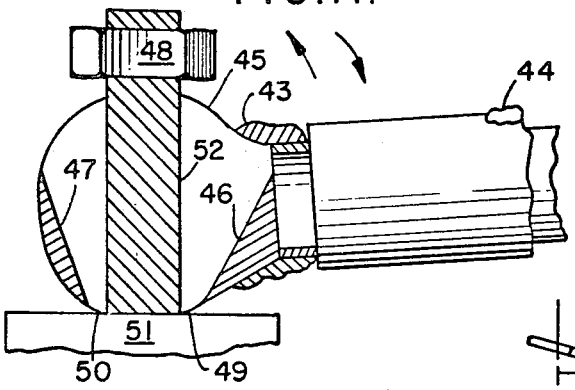
FIG. 22.
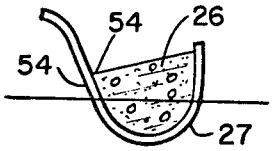
FIG. 23.
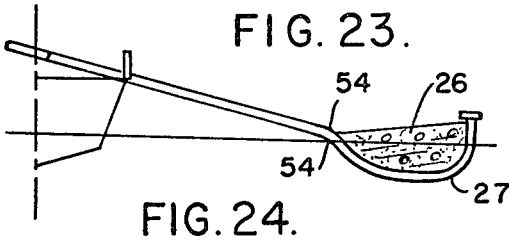
FIG. 18.
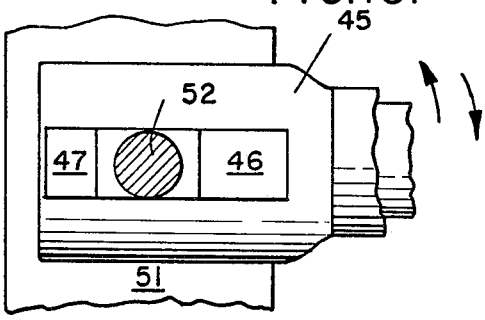
FIG. 24.
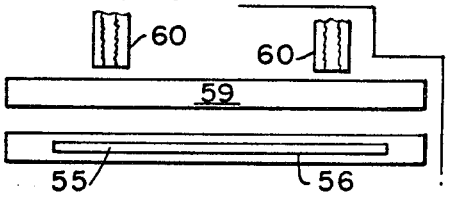
FIG. 25.
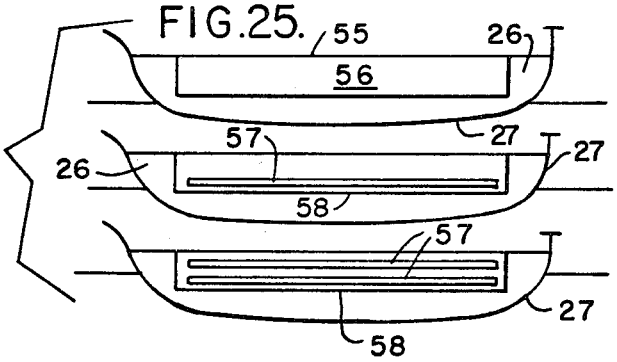
FIG. 19.
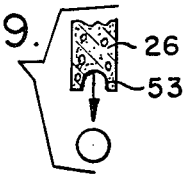
FIG. 20.
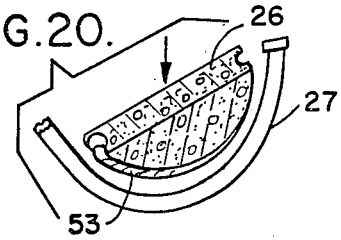
FIG. 26.
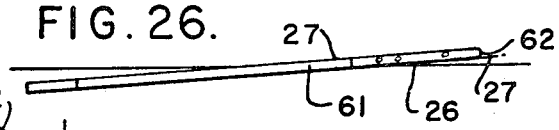
FIG. 21.
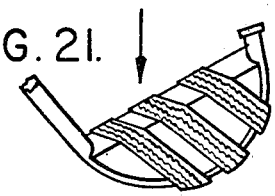
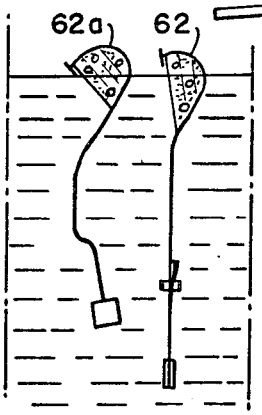
FIG. 27.

CROSSBAR WITH OAR GUIDES FOR BOATS HAVING FRONTWARD-ROWING BOAT-SPANNING OARS

This a division of application Ser. No. 451,563, filed Mar. 15, 1974 now U.S. Pat. No. 3,879,779, which in turn was a division of application Ser. No. 383,379, filed July 27, 1973 now U.S. Pat. No. 3,857,356.

This application relates to a boat mounting for frontward-rowing crisscrossed angular oars having self-surfacing, self-leveling blades, said mounting comprising a crossbar for affixation athwart the gunnels of a rowboat, canoe, kayak, skiff, or other rowable craft by waterproof adhesive-tape clamping, as well as to said oars and blades themselves, and to novel accessories for them, including streamlined, carom-type shields disposed on said mounting for innocuous preclusion of intercontact between oars and boat structure or accessories, in case of extremely abnormal or excessive submergence.

The overall object of the invention is to minimize or eliminate the shortcomings of prior-art oars and their mountings by providing novel oars and novel mountings for them, comprising the following innovations and advantages:

i. Frontwardness of rowing via use of said crisscrossed angular oars;

ii. Instant mountability and demountability of said oars on any ordinary rowable craft via use of said crossbar and its accessories;

iii. Provision for the relatively slight lifting force involved in manipulation of said oars to be exerted in close juxtaposition to the oarsman's chest, rather than with his arms outstretched;

iv. Generous spacing-apart of the grip portions of the oars at all stages of their front-rear and reverse movement, in place of the conflicting or near-conflicting posture of said portions which characterizes prior-art oars generally;

v. Comfortable elevation of said grip portions throughout the return strokes as well as the power strokes of the oars, thereby avoiding the awkwardness incident to the exaggeratedly low posture of prior-art oars during their return strokes;

vi. Marked increase in efficiency of conversion of rowing energy by the oars, due to lessened obliquity of their blades at the beginning and end of power strokes of given lengths, as contrasted with the performance of prior-art oars in this regard;

vii. Marked decrease in breadth of water-area preemption by the oars, due to greater and more efficient lever use of the between-gunnels boat space, as contrasted with the smaller and far less efficient lever use of such space by prior-art oars;

viii. Instant, automatic self-surfacing or self-leveling of the oars to a pre-selected extent of above-water blade protrusion, following any interruption of immersive force upon them during use, as contrasted with the downwardly oblique total or near-total degree of blade submergence which characterizes usual prior-art blades following such interruption;

ix. Immediate pre-provision for a desired extent of such protrusion by simple insertion or extraction of weight rods (or weights-plus-stiffener rods) in horizontal disposition through mouths of thin, elongate pockets in the blades, as contrasted with the apparent absence of analogous such means in prior-art blades;

x. Unique visibility of the blades when their oars are floating freely at a distance from the boat or shore, due to upwardness of pitch achieved by pre-determined shift of the center of gravity of the oar in the direction of its handle; and xi. Life-preserving utility of the oars due to the unique buoyancy of their blades and light-weight, advantageously hollow looms, particularly when extra large such blades have been installed in the loom cradles, with resultant in-effect reduction of the body density of a person clinging to them to a figure approximating, or even below the density of the water.

In the drawings, wherein all figures are to be understood as basically diagrammatic or schematic, and all expressions such as horizontal, upward, front, rear, etc. as being relative and approximate unless otherwise evident, to be more particularly described later on:

FIG. 1 is a rear elevation of the novel crossbar of the invention and associated accessories mounted across the gunnels of a 33-inch beam canoe and pivotally supporting a pair of the novel crisscrossed angular oars of the invention in position of use, with the oarsman facing away from the viewer, i.e., frontwardly;

FIG. 2 is a plan view of the oars of FIG. 1;

FIG. 3 is a rear elevation detail similar to the central lower portion of FIG. 1 except that the canoe has been replaced by a 48-inch beam rowboat, the oarsman's seat is more elevated, and an auxiliary relatively long, upwardly arched crossbar has been introduced as a support for the crossbar of FIG. 1;

FIG. 4 is an exploded side elevation detail depicting the process of adhesive-tape affixation of an elongate-bar type clamp along a gunnel of the boat of FIG. 1, to thereby anchor its crossbar in position of use;

FIG. 5 is the same as FIG. 4 except that the anchoring has been completed;

FIG. 6 is a plan view detail of the parts shown in FIG. 5, plus the application of further adhesive tape crosswise of the clamp bar of FIGS. 5 and 4, and lengthwise of the crossbar, to thereby fix the transverse position of the crossbar relative to the gunnels;

FIG. 7 is an end elevation detail showing the contingent functioning of either one of the carom-type arched shields appearing in FIG. 1;

FIG. 8 is a left-end perspective detail showing the same functioning from a different viewpoint;

FIG. 9 is a perspective detail on enlarged scale of the pivot-end portion and certain adjacent parts of a right-hand-operated loom such as that of FIG. 1;

Figure 15:
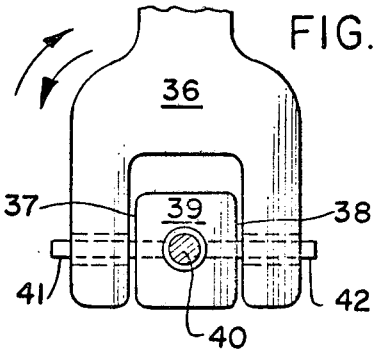
Figure 16:
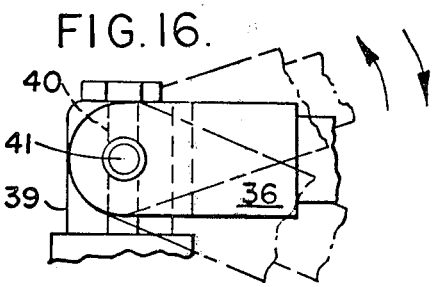
Figure 14:
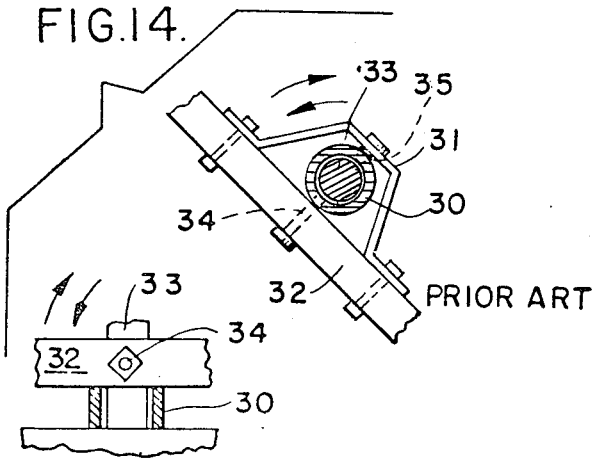

FIG. 14 couples a plan view detail with a side elevation detail of a prior-art structure relevant to a novel pivoting device contemplated for the oars of the invention;

FIG. 15 is a plan view detail of said novel pivoting device;

FIG. 16 is a side elevation detail of the device of FIG. 15;

FIG. 17 is a side elevation detail, largely in cross-section, of a novel pivoting device alternative to that of FIGS. 15–16.

FIG. 18 is a plan view detail of the pivoting device of FIG. 17.

Figure 28:
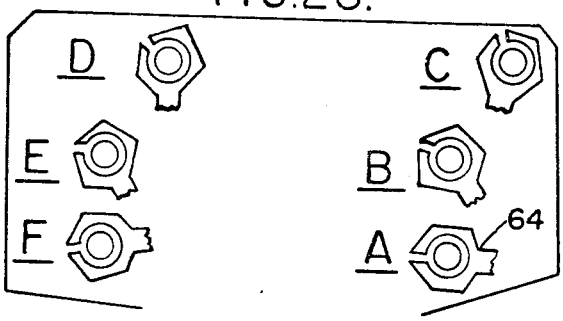
Figure 29:
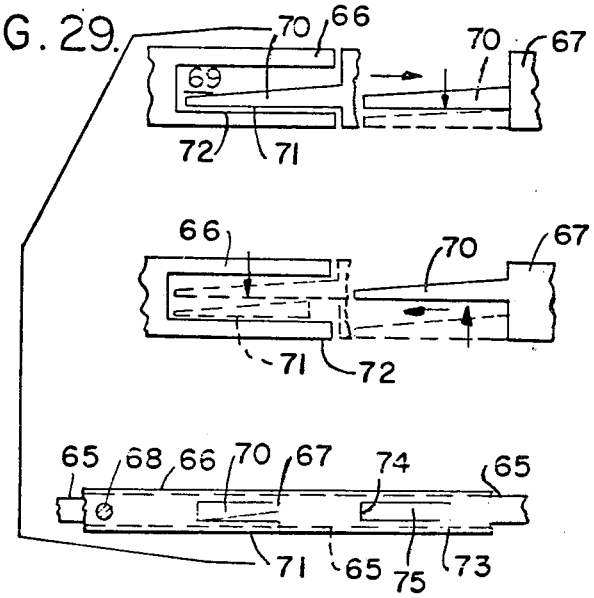
Figure 34:
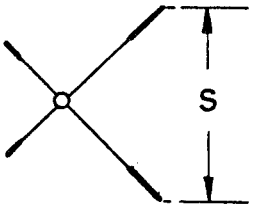
Figure 35:
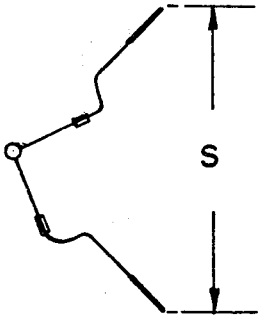
Figure 36:
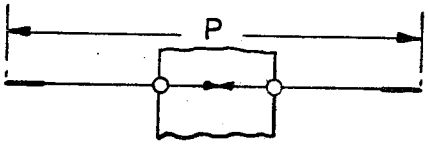
Figure 37:
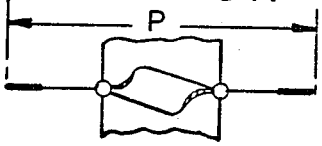
Figure 30:
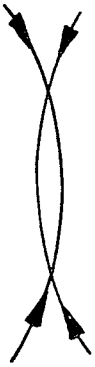
Figure 31:
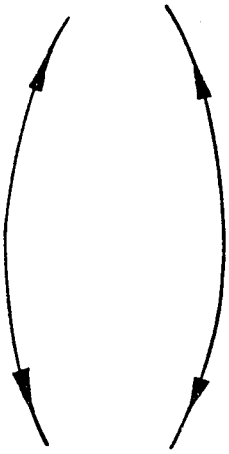
Figure 32:
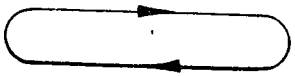
Figure 33:
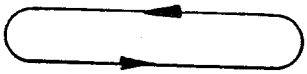

FIG. 19 is an exploded cross-sectional detail of a novel blade of the invention being fed downwardly onto its cradle;

FIG. 20 is an exploded perspective detail looking downward on the parts depicted in FIG. 19;

FIG. 21 is the same as FIG. 20 except after completion of the down-feeding of the blade onto its cradle and subsequent spiral-wrap adhesive-taping of the parts;

FIG. 22 is a side elevation detail of the right end of the oar of FIG. 1, with the locus of its "throat" indicated, said locus corresponding to that of the "throat" or inner blade end-to-loom connection of a usual oar;

FIG. 23 is a side elevation of a usual oar in position of use, except that its blade portion has been replaced by the novel cradle and buoyant blade of the invention, with the locus of its throat being depicted similarly to the locus of the throat in FIG. 22, i.e., as coinciding with the loom connection to the inner end of the blade;

FIG. 24 is an exploded plan view detail depicting in its lower part the blade of FIG. 23, in its middle part an elongate closure strip for the blade mouth, and in its upper part a supply of adhesive tape for affixing said closure strip across the top surface of the blade;

FIG. 25 is a group of three identical side elevation diagrams of a cradled blade such as that of FIGS. 23–24, showing the degree of immersion thereof when unweighted (as in the top diagram), the increased immersion thereof due to insertion of a first stiffener-weight bar into its pocket (as in the middle diagram), and the further increased immersion thereof after insertion of a second stiffener-weight bar (as in the bottom diagram);

FIG. 26 is a side elevation detail depicting the oar of FIG. 23 floating freely apart from the boat, the out-of-water elevation of its blade end having been pre-determined by loading its pivot, or handle, end to thereby shift its center of gravity handleward;

FIG. 27 is a side elevation detail showing the oars of both FIGS. 22 and 23 floating freely apart from the boat, with the aforesaid shifting of their centers of gravity sufficiently handleward to cause them to float uprightly, blade end upward, thereby increasing their above-water visibility beyond that depicted in FIG. 26; said visibility in the latter figure as well as in FIG. 27, however, being thought to be distinctly greater than in the case of any usual prior-art floatable slab-shaped oars floating freely at the water surface;

FIG. 28 is a group of side elevation details depicting the hand and wrist positions of an oarsman feathering one of the crisscrossed angular oars of the invention;

FIG. 29 is a group of side elevation details depicting modification of such oar to permit such style of feathering;

FIG. 30 is essentially a reproduction of the prior-art FIG. 5 of applicant's U.S. Pat. No. 3,324,490 showing the horizontally conflicting or near-conflicting handle-movement paths of conventional oars in use;

FIG. 31 is essentially a reproduction of FIG. 4 of applicant's said patent showing the generously horizontally spaced non-conflicting handle-movement paths of the criss-crossed oars of the invention;

FIG. 32 is a side elevation diagram showing the downward-cramping of said conventional oars on the return stroke;

FIG. 33 is a side elevation diagram corresponding to FIG. 32 except showing the generous upward spacing for the return stroke in the case of the crisscrossed oars of the invention;

FIG. 34 is a plan view diagram depicting the power-stroke length between a 45° starting posture of a backward-rowing oar such as that of FIG. 23 and a 45-degree ending posture thereof;

FIG. 35 is a plan view diagram depicting the corresponding, but much greater power-stroke length and therefore rowing-energy-conversion superiority of a frontward-rowing oar such as those of FIG. 1 (they being exactly alike) having the same overall length as the oar of FIG. 34;

FIG. 36 illustrates the relatively great breadth of water area pre-empted by a pair of usual oars; and FIG. 37 illustrates the far less breadth of water area pre-empted by crisscrossed angular oars of the invention having the same individual overall length as that of the oars of FIG. 36; such lessening in breadth being regarded as of major significance in situations such as encountered during canoe trips on narrow rivers, streams, canals and the like— in fact, wherever crowded boating conditions are apt to exist.

Referring to the drawings in detail:

In FIGS. 1–13 crossbar 1, supported on gunnels 2 and 3, is fixed in place by clamps 4 and 5 (5 being visible only in FIG. 13), which are anchored tightly to the boat by waterproof, pressure-sensitive adhesive tape 6, which itself is tightly adhered to both the inner and the outer surfaces (unnumbered) of the sidewalls of the boat. To insure against lateral displacement of the crossbar, adhesive tape 7 is tightly applied across the tops of clamps 4 and 5 plus adjacent portions of crossbar 1, as best seen in FIG. 6. Pivot-eye portion 8 of left-hand oar 9 is sleeved on oarlock pin 10, as shown in FIGS. 1, 3 and 13, said pin 10 being snugly secured by upright cylindrical oarlock socket 11 (depicted by dash lines in FIG. 3 and understood in FIGS. 1 and 13), located at the center of pivot-pin block 12. Left-side counterparts of said members 8–12 will be readily apparent without numbering.

Bearing in mind that the assembly of parts in FIG. 1 is symmetrical, and that all numbered parts to the right side of center plane 13 of the boat (said center plane being the vertical plane which includes the geometrical longitudinal axis of the boat) have identical counterparts to the left side thereof, said counterparts are readily identifiable and, unless otherwise appears, will be left unnumbered. Since the right-hand oar thus is identical with left-hand oar 9, as appears in the FIG. 1 at-rest position, it can be seen that each of their looms slopes obliquely upward from its pivot-eye portion to a point beyond said center plane and then, as at angle point 14, turns toward and then continues on until it meets transverse vertical plane 15 (which includes the centers of oarlock pin 10 and its left-side counterpart) and then, as at angle point 16, turns waterward and remains in said plane 15 throughout the rest of its length.

Reverting to crossbar 1, particularly as shown in FIGS. 7–8, arch-like carom-type shield 17 is affixed to pivot-pin block 18 (shown in FIG. 8 optionally united to the upper surface of crossbar 1, instead of the under surface thereof as is pivot-pin block 12 in FIGS. 1, 3 and 13) in position to present a rearwardly-upwardly slanting portion 19 which will be glancingly contacted by loom portion 20 whenever the latter, due e.g., to stormy conditions, may happen to descend to such an extremely low elevation as would occasion such contact.

In FIG. 9 downwardly-frontwardly curving leaf guide 21 is affixed to crossbar 1 in close proximity to and beneath reinforcing sleeve 22 of loom portion 23, to glancingly guide said sleeve 22 upwardly, in manner analogous to that of said portion 19 of shield 17, and thereby insure against any chance of downward contacting of gunnel 3 (FIGS. 1, 3 and 13) by the right-hand oar. (An optional variation of the positioning of said guide 21 is shown in FIG. 13.)

A still further form of analogous guide is exemplified by surface 24 in FIGS. 1 and 3 (25 in FIG. 9), whose purpose is to insure against the highly unlikely yet conceivable contingency of hooking inter-engagement between outer portions of the looms and end portions of the crossbar.

Details of blades 26 and blade cradles 27, formed by terminal portions of the looms themselves, will be set out below.

Figure 10:
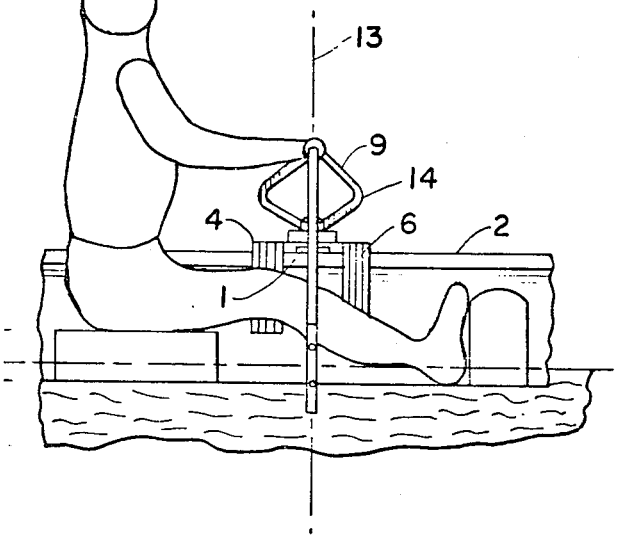
FIG. 10 is a side elevation of the oarsman and a central portion of the parts appearing in FIG. 1, except that the pivot-pin block in FIG. 10 is affixed to the upper surface of the crossbar rather than to its under surface.
Figure 11:
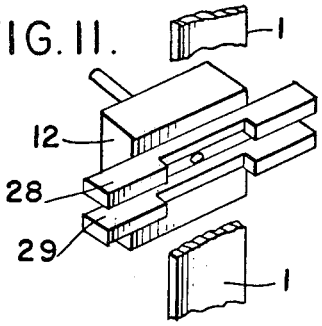
FIG. 11 is a bottom perspective of an end portion of a partially broken-away crossbar such as that of FIG. 9, but with clamp bars such as the one appearing in FIGS. 4–6 affixed to the bottom of a pivot-pin block carried by it.
Figure 12:
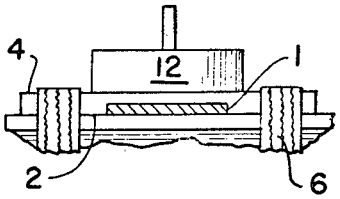
FIG. 12 is the same as FIG. 11 except that the anchoring has been completed.
Figure 13:
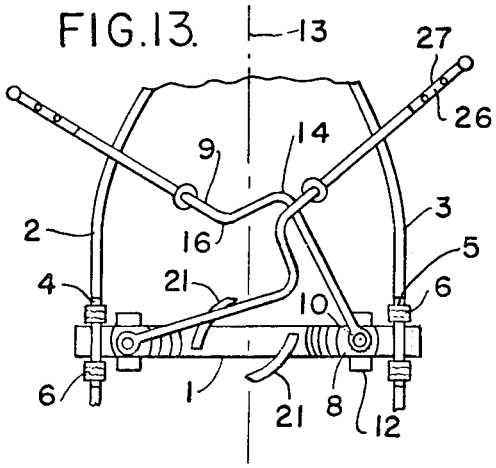
FIG. 13 is a plan view detail of the oars and associated parts appearing in FIG. 1 except that the oars are in a far frontward posture and certain reserve or contingent guide structures having been added on the crossbar.

Since the center-to-center distance between the oarlock pins in FIG. 1 is 36 inches, FIGS. 11–12 have been addressed to the situation where the crossbar needs to be mounted on a boat having a 36-inch beam, in which case the presence of pivot-pin block 12 on the crossbar would preclude use of separate clamps such as 4 and 5 (FIGS. 4–6) for affixing the crossbar to the boat in precisely symmetrical relation thereto. Hence, corresponding clamps 28 and 29 are integrated to the bottom of the overlying pivot-pin block 12, thereby permitting tape-clamping of their outward portions to the gunnels in the same manner as depicted in FIGS. 4–6.

FIG. 14 represents applicant's recollection of an oarlock on a Hans Klepper Corporation boat displayed in Washington, D.C., during December, 1971, which applicant did not then and has not since seen or heard described. In said figure, vertical oarlock socket 30 is pivotally mounted between bracket 31 and loom 32 so as to permit simultaneous rotative reciprocation of the loom 32 about vertical pivot pin 33, and up-down rotative reciprocation thereof about horizontal pivot pins 34 and 35.

While the structures of FIGS. 15–16 embody this same general principle, they apply to the terminal portion of a crisscrossed angular oar of the invention rather than to a conventional oar, and do not require the offsetting expedient shown in FIG. 14. In other words, said structures expand the width of the oar symmetrically rather than to one side only, besides permitting unlimited dimensioning and strength of the parts plus shifting of the oar's center of gravity handleward, such shifting being essential to achievement of the unique upright-floating visibility of lost oars which is discussed below. Thus, oar end portion 36 is bifurcated to flank opposite faces 37 and 38 of pivot-pin block 39 and thereby provide for horizontal rotative movement about vertical pivot pin 40 either separately or concomitantly with up-down reciprocation about horizontal pivot pins 41 and 42, during use.

In FIGS. 17–18 the parts correspond to those appearing in FIG. 9 except that welding metal used in their uniting is indicated at 43 and 44, top pivot-eye piece 45 is rounded, and the upward flaring of the front and rear walls 46 and 47 of the pivot-eye piece 45 is more easily visible. The spacing leeway between the nut 48 and the top of the pivot-eye piece 45, plus that between the front and rear bottom boundaries 49 and 50 of the eye, permits up-down reciprocation without need for horizontal pivot pins, i.e., via said leeway under the nut 48 at the top, and slight slippage of said boundaries 49 and 50 across the pivot-pin block 51 at the bottom. And the horizontal reciprocation about pivot pin 52 is similar to that depicted in FIG. 16.

In FIGS. 19–21 inverted peripheral trough 53 in the rigid foam (e.g., expanded polystyrene having a bulk density of, say, about 3 points per cu. ft.) of the blade 26 may be formed by in-place foaming in a complementarily configurated mold, or by searing with a complementarily dimensioned, heated round rod to appropriately convert the surface polymer into a tough, rigid skin, or, if desired, by purely mechanical means.

Because of the form-fit between the sides of the trough 53 and the converging upper surface of the tubular-loom cradle 27 on and against which it snugly rests, no displacement will normally occur during use, unless by water-induced upward floating of the blade. And this is insured against by water-proof, pressure-sensitive adhesive-taping such as indicated in FIG. 21.

The significance of FIGS. 22 and 23 and the loci 54 of the throats appearing in them has already been pointed out, except for the matter of optimum extent of blade immersion. It has long been appreciated that substantial submergence of the upper edge of the blade during use tends to produce "twists" and "twirls" (Brit. 15,375 of 1913) so that an abovewater posture of the entire length of said edge is desirable (U.S. Pat. No. 2,367,222, FIG. 8). But there has not been complete unanimity as to the optimum extent of such posture. Thus, page 127 of Aquatics Handbook by M. A. Gabrielsen et al., Prentice-Hall, Inc., 1960, states: "About ⅔ or ¾ of the blade should enter the water"; page 97 of Boating from Bow to Stern by J. P. Kenealy, Dodd, Mead & Co., 1966, advises that the blades should "dip three-quarters submerged in the water"; and page 54 of an article on "How to Handle a Rowboat" by F. Clark (Boating Journal, April-May, 1966, pages 50–55 ) advises: "Don't dig in too deeply; ⅞ths of blade in water is enough." Of course, these statements were made in contemplation of usual oars and blades, not of the crisscrossed oars of the invention. Consequently, in view of the extremely light weight of the latter, it is not seen why above-water protrusion of more than ⅛, ¼ or ⅓ of their faces would be undesirable, unless on account of resultantly increased air or wind pressure during stroking or feathering, or why deeper immersion, if desired, might not be practiced, with extra-large slab-shaped blades, to thereby achieve more powerful and therefore faster rowing.

In such case, the novel self-leveling action of a blade of the invention can readily be provided for by the expedient illustrated in FIGS. 24 and 25. In said figures, upwardly open mouth 55 of narrow, elongate pocket 56 of upright-in-use blade 26 seated in cradle 27 is disposed for reception of one or more weight, or stiffener-plus-weight, bars 57 into the pocket 56, so that it will rest lengthwise on the bottom 58 thereof. Of course, a shorter pocket and differently shaped weights could be used, but it is preferred to employ elongate weights (either singly or in multiples) comprising considerable vertical dimension, so as to thereby supplement the inherent rigidity of the blade and its skin and/or other facing against undue flexure in use. Such rigidity per se can be made very substantial merely by applying the sear treatment of the flat surfaces of the blade in manner such as mentioned in connection with FIGS. 19–21 above, or by in-place foam-molding methods well known to workers in that art. By way of illustration, it may be remarked that if the blade be 15 inches in length and 1 inch wide (at the water level) a bar weighing ½ pound will produce about 1 inch of submergence, since the volume of displaced water will be 15 cu. in. and therefore have a weight of about ½ pound.

Sealing of the mouth 55 of the pocket 56 is accomplished by affixing closure element 59 with waterproof adhesive tape 60 applied across its top and down along each subjacent side surface of the blade.

In FIG. 26 oar 61 corresponds to a usual oar except for its novel blade cradle 27 and blade 26, and the fact that its center of gravity has been located sufficiently handleward for its tip 62 to be elevated entirely above the water level, thereby giving it improved visibility as compared with tips of floatable conventional oars when lost in the water. Preferably the elevation of the tip 62 will be such that an above-water vertical distance equal to at least ½, 5/4, twice or more the maximum thickness of the blade will underlie said elevation. Of course, as said handleward shifting of the center of gravity is increased, the counter-clockewise rotation of the blade will speed up until it reaches the optimum posture shown in FIG. 27.

Due to necessary (for strength) weight of the pivot-contacting portion 63 of the angular oar 9 in said figure, the free-floating posture of such oar and its tip 62-*a* will generally be as depicted therein.

In applying said test, the "tip" of the oar is taken to be the point on the blade end farthest from the pivot, or handle, end.

In FIG. 28, "A" represents the posture 64 of an oarsman's hand and wrist at the end of a power stroke with one of the novel oars 9 of the invention, "B" said posture during lifting and feathering of the oar, and "C" said posture at the conclusion thereof; while "D" represents said posture following frontward manipulation of the oar preparatory to a new power stroke, "E" said posture during lowering and de-feathering of the oar, and "F" said posture at the beginning of the new power stroke.

The optional structuring shown in FIG. 29 adapts the novel crisscrossed oars of the invention to feathering in the manner depicted by FIG. 28. Thus, an inner splice tube 65 (shown in the bottom portion of FIG. 29) is used, on which both sections 66 and 67 of a two-section loom are sleeved, the pivotward section 66 being immovably affixed to it by rivet 68, and recessed at 69 to receive a tooth 70 protruding from the bladeward section 67. During the power stroke the lower edge 71 of the tooth engages the lower wall 72 of this recess, and is blocked by it against rotational movement during the F to A power stroke. At the end of the latter, however, the oarsman applies an outward force to said bladeward section 67, as indicated by the horizontal arrow in the top portion of FIG. 29 and, having thereby released the tooth from said engagement, feathers the bladeward section into the posture indicated by the dash lines at the lower right bottom of said top portion. Next, when the D position is reached, he feeds the tooth 70 back into said recess 69 and thereupon rotates it into reengagement with said wall 72, for the start of a new power stroke—all as depicted by the arrows and dash lines in FIG. 29.

Endward displacement of the slideable bladeward section 67 is precluded by the lug 73 on the splice tube 65, said lug being positioned to engage the left end 74 of the horizontal opening 75 in the bladeward section 67, in the event of excessive outward movement thereof during use.

The above explained significance of diagrammatic FIGS. 30–33 in respect to abundance of the available space for uncramped and comfortably elevated hand movements during manipulation of the crisscrossed oars of the invention, i.e., as contrasted with the restricted and cramped hand-movement space in the case of usual oars, is repeated here.

The overall length of each of the oars in FIGS. 34–37 is 5½ feet. No numeralizing of their parts appears needed, in view of the general description already made of them hereinabove.

FIGS. 34 and 35 each shows an oar in position of use with its blade at a frontward 45°-angle stroke-starting posture, as well as the same blade in a 45°-angle stroke-ending posture; the oar of FIG. 34 being a conventional (lever-of-the-first-kind) oar, while that of FIG. 35 is a crisscross angular (lever-of-the-third-kind) oar of the invention. It is notable that the stroke length S in FIG. 34 is only 5¼ feet, while that in FIG. 35 is 7¾ feet (about 50 percent greater).

FIGS. 36 and 37 each shows a pair of the same oars as respectively shown in FIGS. 34–35, but pivoted on the gunnels of a 36-inch-beam boat; the breadth of water area pre-emption P by the conventional pair (FIG. 36) being 11 feet, as contrasted with the mere 8 feet of such pre-emption by the crisscrossed angular oars of the invention (FIG. 37).

Referring again to the crossbar of FIGS. 1–13, its novel tape-fastening makes it readily eligible for use (optionally with obvious variations) as a thwart-type support for any desired objects including, e.g., seating of passengers.

Particularly appropriate illustrations of suitable pressure-sensitive adhesive tapes for said fastening are exemplified, e.g., by "Scotch" (3M Company) Industrial Tape Nos. 890 or 870.

Should a particular tape happen to prove water-permeable to more than a negligible extent, it could be protected by a thin overlay of rubber-type tape such as the tapes commonly available in hardware stores under the designation "electrical" tapes.

It may be remarked that preliminary application of a relatively thick "double-stick" tape to the top of the gunnels of a boat, before placing the clamp bars of FIGS. 4–6 on them, is an optional expedient.

When the crossbar of FIGS. 1–13 is used for the purposes directly contemplated in those figures, the affixation of the pivot-pin block may be by any desired means, e.g., gluing with waterproof epoxy-type glues and/or bolting.

When the pin blocks are affixed to the upper surface of the crossbar, as in FIG. 12, and given suitable height, the crossbar becomes useful as a mounting for lever-of-the-first-kind oars which may comprise oarlock sockets such e.g., as the one shown in FIG. 14, without difficulty arising from intercontact with the crossbar during the return stroke. In such case, the cramped-space inconveniences depicted in FIGS. 30–33 will be obviated. And in addition, lengthening of the crossbar will make available any desired outrigger loci for placement of the pivots of such oars.

As regards the tubular looms of the figures, the ends of course are closed against entry of water, as e.g., by rubber stoppers or rubber furniture tips of appropriate diameter.

The aluminum alloy known as 6061-T6WWT, in 1-inch O.D. or ⅞-inch O.D. and 0.065-inch thickness has been found satisfactory, particularly when its angles have been imparted by cold-bending so as to preserve the temper of the tubing.

Resistance to sea water is enhanced by anodizing; but alternatively, alloys of comparable strength and rigidity, together with extremely high inherent resistance to sea water, are understood to be presently available.

Said 6061 alloy is excellently suitable for the cradle-segment end of the oars of the invention, by virtue of its toughness and ruggedness, when such segment is used for pushing the craft from shore or for making pushing contact with the bottom of a stream or lake.

A unique advantage of making the subject oars exactly alike is that it enables a person seated oppositely to the oarsman to "take over" the rowing from him, without any shifting of position by either. Also, should any overstressing occur during use of the oars, i.e., such as would give rise to incipient distortion, mere switching of the oars would readily correct it via the well-known phenomenon of "work-hardening".

"Blade-space", as used herein and in the appended claims, means the space enclosed within an imaginary flexible film wrapped tightly around all portions of the entire blade.

Should collapsibility of the subject oars be desired, that of course may be accomplished by segmentation in accordance with techniques well known in the art; or an internal splice tube analogous to tube 65 in FIG. 29 but caged in place, e.g., by bends in the segments of the loom to be joinable, may be employed, with such segments inter-united, e.g., by longitudinal laps of waterproof adhesive tape, such laps optionally being reenforced by circumferential laps in turn applied to them.

Strengthening tubular inserts can, of course, be used as desired, in any portions of the looms, e.g., within a portion such as the loom portion 23 appearing in FIG. 9.

In connection with the optional hollowness of the tubular looms, it will be noted that internal re-enforcement with rigid foam is available, as well as external re-enforcement with, e.g., fiberglass-resin compositions in accordance with U.S. Pat. No. 3,561,760 (col. 2).

As for hollow blades of the prior art, it may be remarked that if they spring a leak their buoyancy is gone; whereas with expanded polystyrene or polyurethane, e.g., abrasion or gouging of the same causes no such trouble, owing not only to the almost total water-impermeability thereof, but also to the relative simplicity of repairing the blade in such case.

Production of the tough, rigid skin contemplated for the water-engaging surfaces of the blade, as spoken of elsewhere herein, can be carried out by methods pointed out on page 169 of the Journal of Cellular Plastics, Vol. 6, No. 4 (July–Aug., 1970), in the course of an article entitled "A New Generation of Structural Foam Polymers" by R. L. Grieve et al. (Upjohn Co. Research Labs., North Haven, Conn.), wherein it is stated that "The applications of integral skin foam molding for structural and decorative parts are unlimited . . . " And on page 167 (in the course of the same article) the statement appears that "The integral skin foam process leads naturally to the concept of very stiff (high modulus) integrated parts. The outer surface and the reinforcing configuration may be achieved in a single molding", with stiffness of course enhanced "by ribbing wherever possible."

The wide variety of cellular solids eligible for use in the bodies of the blades—particularly when internal structures embedded via pre-molding or pre-foaming processes are to be provided, e.g., structures such as the pockets in FIGS. 24–25 and the peripheral recesses of FIGS. 9 and 19–21—will become evident on inspection of "The Survey of Foamed Plastics" appearing on pages 294–296 of The Modern Plastics Encyclopedia for 1965 which accompanied the issue of Modern Plastics (published by McGraw-Hill, Inc.) for Sept., 1964, as well, of course, as in the highly revealing U.S. patent literature on the subject.

Supplementing the introductory statement of advantages of the invention appearing hereinabove, it may be remarked that by relieving oarsmen of having to keep looking over their shoulders to see where they are going, the new oars are uniquely suited to general use by all persons preferring rowing to motor power, whether for exercise, quietness, economy, ecology, or otherwise, and even more so to special use by all persons employing rowboats for such purposes as sneak approaches in hunting, fishing, exploring, and picture-taking; tender service over shallow, swampy, obstruction-ridden waters; activities potentially involving rescue or other emergency operations; rental to novelty-seekers at amusement park or playground lakes and ponds; and physical therapy at recreation, convalescent and rehabilitation centers. Also, in reduced sizes on small, easily maneuverable boats, the new oars open up an unlimited range of water sports, games, contests, and group exercises hitherto automatically ruled out by risks of collision and other mishaps inherent in the centuries-old backward-facing rowing done with usual oars, but eliminated by the forward-facing rowing done with the new oars.

What is claimed is:

1. A crossbar for placement athwart the gunnels of a rowboat, canoe, kayak, skiff or like craft, a pair of oar pivot pins disposed in spaced-apart relationship on said crossbar, a pair of carom-type shields for said pins also disposed in spaced-apart relationship on said crossbar and respectively adjacent to said pins, each of said shields comprising a rearwardly-upwardly slanting portion located farther frontward than the one of said pins to which it is respectively adjacent and in the path, during use, of the rearwardly moving loom of a frontward-rowing boat-spanning oar pivoted on the other of said pins, intercontact of such loom with said one of said pins consequently being precluded by said rearwardly-upwardly slanting portion lying in the path of such loom as aforesaid.

2. The crossbar of claim 1 which is upwardly convoluted at spaced-apart loci intermediate said pins, thereby providing enhanced knee-space beneath said crossbar.

3. In combination with the crossbar of claim 1 a boat having a right-side gunnel and a left-side gunnel, said crossbar being disposed transversely athwart said gunnels and receiving support from them.

4. The combination of claim 3 wherein a downwardly-frontwardly curving leaf guide is disposed on said crossbar it a locus intermediate said pins, thereby insuring against intercontact between a said loom and said crossbar during use.

5. The combination of claim 3 wherein said crossbar comprises raised guide surfaces respectively underlying said looms at loci laterally adjacent said pins, thereby insuring against hooking inter-engagement between outer portions of said looms and terminal portions of said crossbar adjacent said outer portions during use.

* * * * *